US005358144A

United States Patent [19]

Mock

[11] Patent Number: 5,358,144

[45] Date of Patent: Oct. 25, 1994

[54] SELF DEFENSE BRACELET

[76] Inventor: Jerry L. Mock, 2510 Leonard Rd., Baltimore, Ohio 43105

[21] Appl. No.: 130,731

[22] Filed: Oct. 4, 1993

[51] Int. Cl.[5] ..... B67D 5/64

[52] U.S. Cl. ..... 222/78; 222/39; 222/175

[58] Field of Search ..... 222/39, 78, 175, 394; 63/1 R, DIG. 1; 224/179, 164, 219; 109/28-31

[56] References Cited

U.S. PATENT DOCUMENTS

| | | | |
|---|---|---|---|
| 2,235,350 | 3/1941 | Anderson | 224/28 |
| 3,830,404 | 8/1974 | Frazer | 222/78 |
| 4,023,712 | 5/1977 | Babiak et al. | 222/175 |
| 4,058,237 | 11/1977 | Luke | 222/78 |
| 4,061,249 | 12/1977 | Smith | 222/78 |
| 4,135,645 | 1/1979 | Kimmell | 222/78 X |
| 4,241,850 | 12/1980 | Speer | 222/39 |
| 4,463,879 | 8/1984 | Des Voignes | 222/175 |
| 4,550,861 | 11/1985 | Fay, Sr. et al. | 222/78 |
| 5,088,624 | 2/1992 | Hackett et al. | 222/78 |
| 5,217,143 | 6/1993 | Aitken | 222/175 X |

*Primary Examiner*—Andres Kashnikow
*Assistant Examiner*—Kenneth DeRosa

[57] ABSTRACT

A bracelet containing a chamber for storing a chemical repellant such as Mace may be inconspicuously worn by individuals and, when needed, can be used to protect the wearer in case they are attacked by pressing an activation button for spraying the attacker with the repellant. The bracelet can also contain an audible warning or alarm device such as a horn.

3 Claims, 4 Drawing Sheets

SELF DEFENSE BRACELET

BACKGROUND OF THE INVENTION

1. Field of the Invention

The present invention relates generally to self-defense devices, and more particularly, to a bracelet especially adapted to contain a canister of mace or other repellant.

2. Description of the Prior Art

Self-protection devices in the form of canisters holding a chemical repellant such as Mace or tear gas or pepper gas or the like are well known in the prior art (see for example U.S. Pat. No. 3,443,333 showing a tear gas pistol). It is also known in the prior art to have a glove with a pocket for holding a container of chemical repellant (see U.S. Pat. No. 5,088,121).

Thus, while the foregoing body of prior art indicates it to be well known to use chemical repellents such as Mace and the like, the provision of a more simple and cost effective device is not contemplated. Nor does the prior art described above teach or suggest a bracelet which can contain a chemical repellant such as Mace which may be inconspicuously worn by individuals and which can be used to protect the wearer in case they are attacked. The foregoing disadvantages are overcome by the unique self-defense bracelet of the present invention as will be made apparent from the following description thereof. Other advantages of the present invention over the prior art also will be rendered evident.

SUMMARY OF THE INVENTION

To achieve the foregoing and other advantages, the present invention, briefly described, provides a bracelet containing a chamber for storing a chemical repellant such as Mace which may be inconspicuously worn by individuals and, if and when needed, can be used to protect the wearer in case they are attacked by pressing an activation button for spraying the attacker with the repellant. The bracelet can also contain an audible warning or alarm device such as a horn.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the applications, which only is measured by the claims, nor is it intended to be limiting as to the scope of the invention in any way.

It is therefore an object of the present invention to provide a new self-defense bracelet which all of the advantages of the prior art and none of the disadvantages.

It is another object of the present invention to provide a new self-defense bracelet which may be easily and efficiently manufactured and marketed.

It is a further objective of the present invention to provide a new self-defense bracelet which is of durable and reliable construction.

An even further object of the present invention is to provide a new self-defense bracelet which is susceptible of a low cost of manufacture with regard to both materials and labor, and which accordingly is then susceptible of low prices of sale to the consuming public, thereby making such self-defense bracelet available to the buying public.

Still yet a further object of the present invention is to provide a new self-defense bracelet which contains a chamber for storing a chemical repellant such as Mace or tear gas or pepper gas or the like.

It is still a further object of the present invention is to provide a new self-defense bracelet which may be inconspicuously worn by individuals and can be used to protect themselves in case they are attacked by pressing an activation button for spraying the attacker with the repellant.

Still a further object of the present invention is to provide a new self-defense bracelet including means for holding a chemical repellant and means for spraying an attacker with the chemical repellant.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

Figure 1:
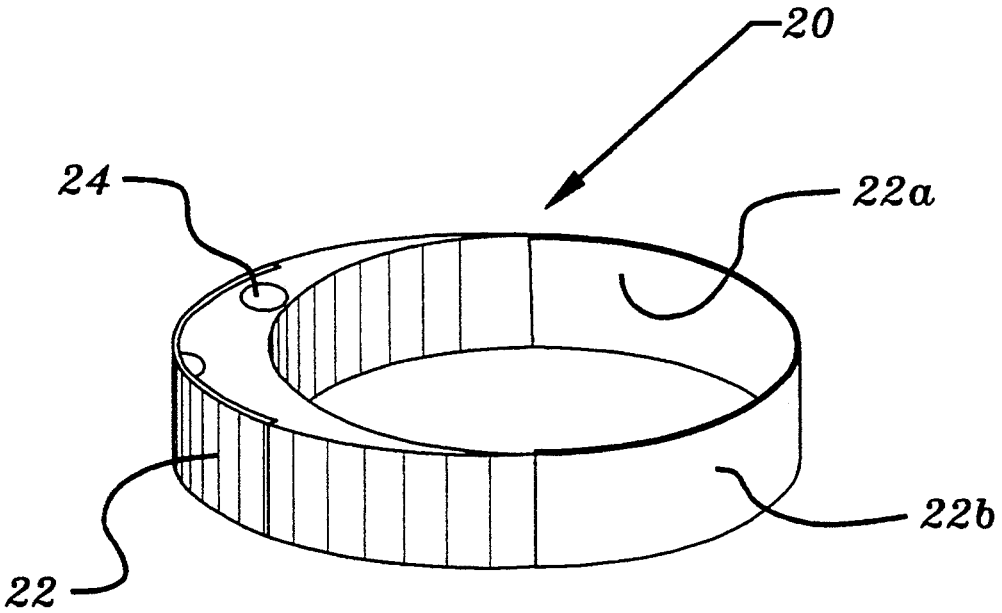
FIG. 1 is a perspective view showing the first preferred embodiment of the self-defense bracelet of the present invention.
Figure 2:
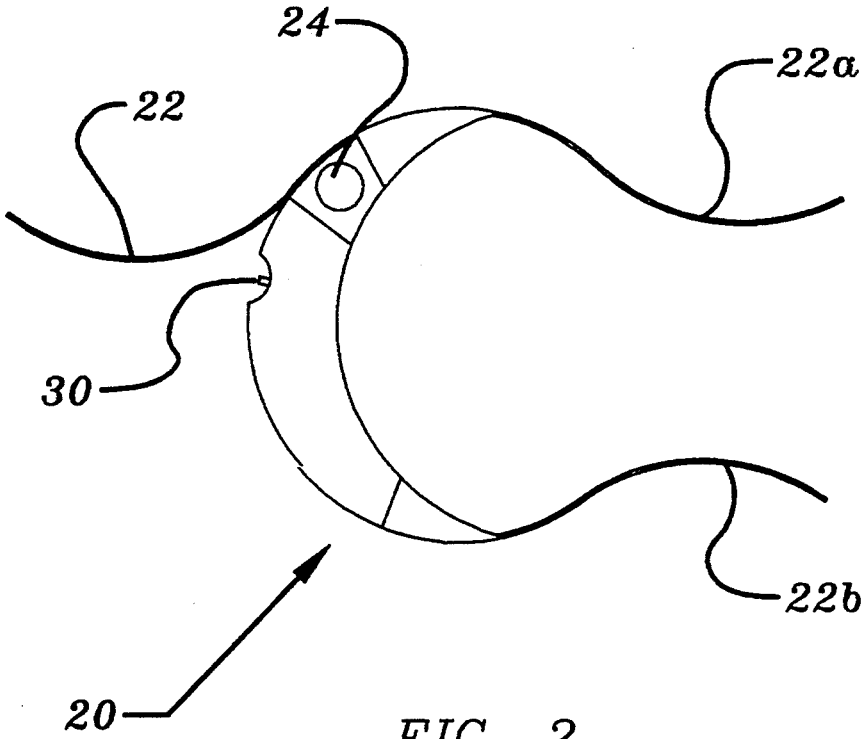
FIG. 2 is a top view of the self-defense bracelet of FIG. 1 in accordance with the present invention.
Figure 3:
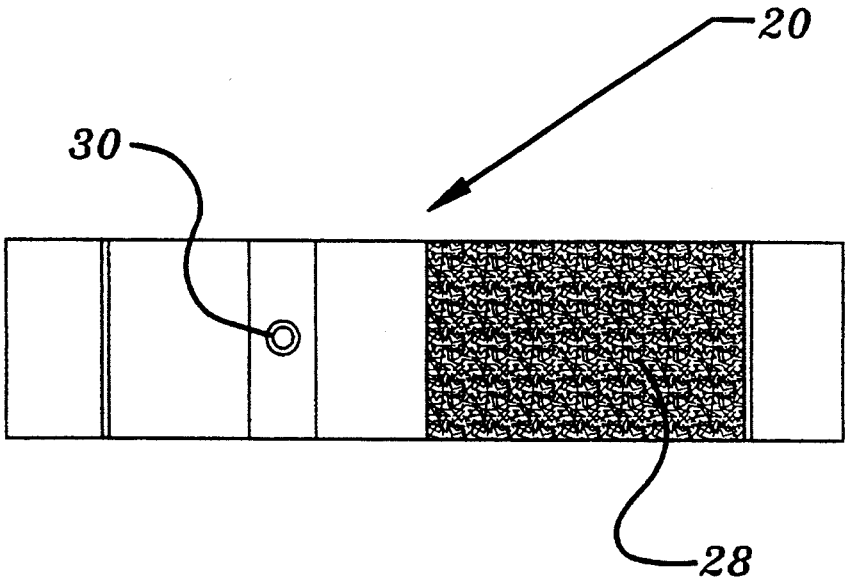
FIG. 3 is a front view of the self-defense bracelet of FIGS. 1 and 2 in accordance with the present invention.
Figure 4:
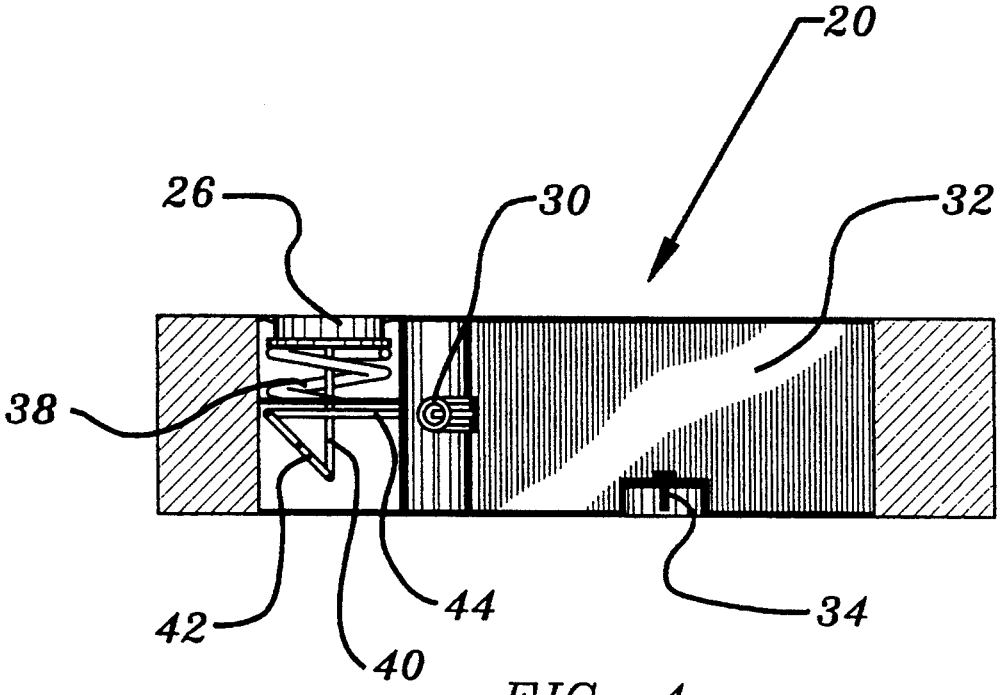
FIG. 4 is a cross sectional front view of the self-defense bracelet of FIGS. 1–3 in accordance with the present invention.

With reference now to the drawings, a new self-defense bracelet embodying the principles and concepts of the present invention will be described.

Turning initially to FIGS. 1–4, there is shown a first exemplary embodiment of the self-defense bracelet of the invention generally designated by reference numeral 20. In its preferred form, self-defense bracelet 20 is shaped to fit around a wearer's wrist and is constructed to have an innocuous exterior appearance like a typical bracelet such that potential attackers will not be alerted to the bracelet.

The bracelet 20 has a pair of mating hook and loop material (preferably and for example VELCRO) straps 22*a* and 22*b*. The bracelet 20 can be secured to a wearer's wrist by mating together the two hook and loop straps 22*a* and 22*b* (as can be seen most clearly in FIG. 2). While it is preferred that the bracelet be secured using hook and loop on straps, of course any suitable means for securing the bracelet 20 to the wearer's wrist can be utilized and should be considered within the scope of the invention.

In the front of the bracelet 20, a cover 24, preferably also made with a hook and loop material such as VELCRO, is used to cover a gas spray outlet nozzle 30. The VELCRO cover 24 can made to mate with a corresponding hook and loop material (VELCRO) attachment strip 28. An activation button 26 for activating the spraying of chemical repellant sits on top and near the front of the bracelet 20.

Chemical repellant can be stored under pressure in a gas chamber 32. The repellant can be added to the gas chamber 32 through refill valve 34.

The activation button 26 is connected to a pressure bar 40. A spring 38 urges the button 26 up to the top of the bracelet 20 away from the pressure bar 40. The pressure bar 40 is connected to a pivot bar 42 which itself is connected to an actuator bar 44 which can move to open the spray nozzle 30.

Use of the self-defense bracelet 20 of the present invention is very simple. A wearer attaches the bracelet 20 to their wrist by mating together the two hook and loop material (VELCRO) straps 22*a*, 22*b* together. If the wearer notices anyone suspicious or if for some reason does not feel completely safe, the wearer can inconspicuously (without alerting a potential attacker that the attacker has anything to worry about) move the hook and loop (VELCRO) cover 24 away from covering the outlet nozzle 30. If an attacker actually does attack, the wearer can aim the bracelet at the attacker's face and push down the activation button 26. Pushing down on the activation button 25 against the force of spring 38 forces down pressure bar 40, which in turn causes pivot bar 42 to pivot and push actuator bar 44 to open a valve to let chemical repellant, such as Mace, tear gas, pepper spray, or the like spray out of gas chamber 32 (under the force of the pressure in gas chamber 30) through gas spray outlet nozzle 30 and into the attacker's face.

After use, the gas chamber can be refilled through refill valve 34.

Figure 5:
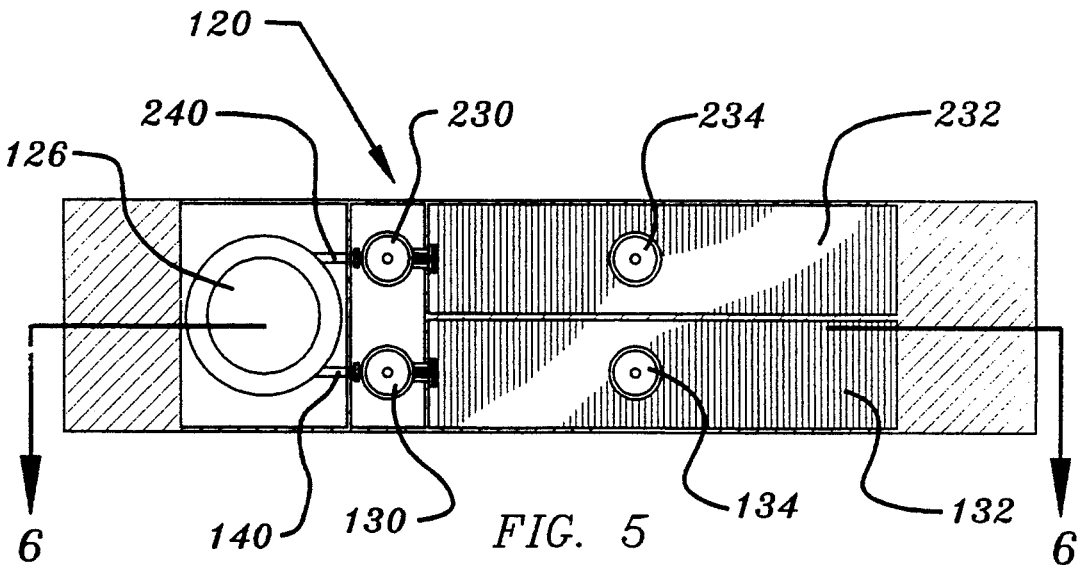
FIG. 5 is a cross-sectional front view in elevation of a second preferred embodiment of the present invention.
Figure 6:
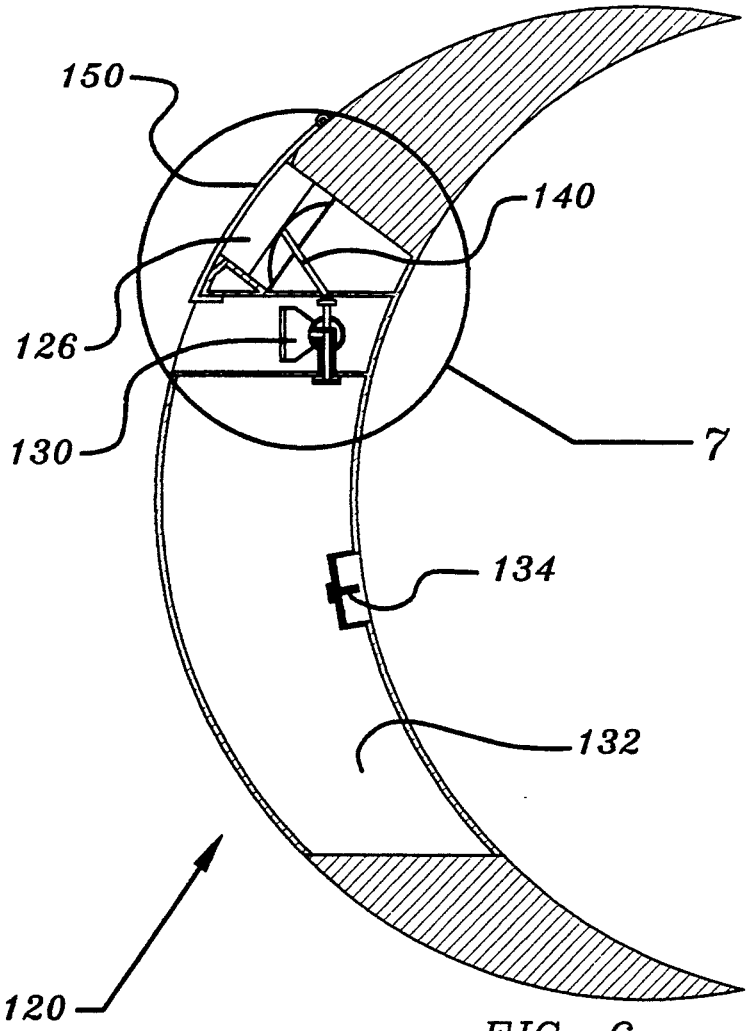
FIG. 6 is a cross-sectional top view of the second preferred embodiment of the present invention taken along line 6—6 of FIG. 5.
Figure 7:
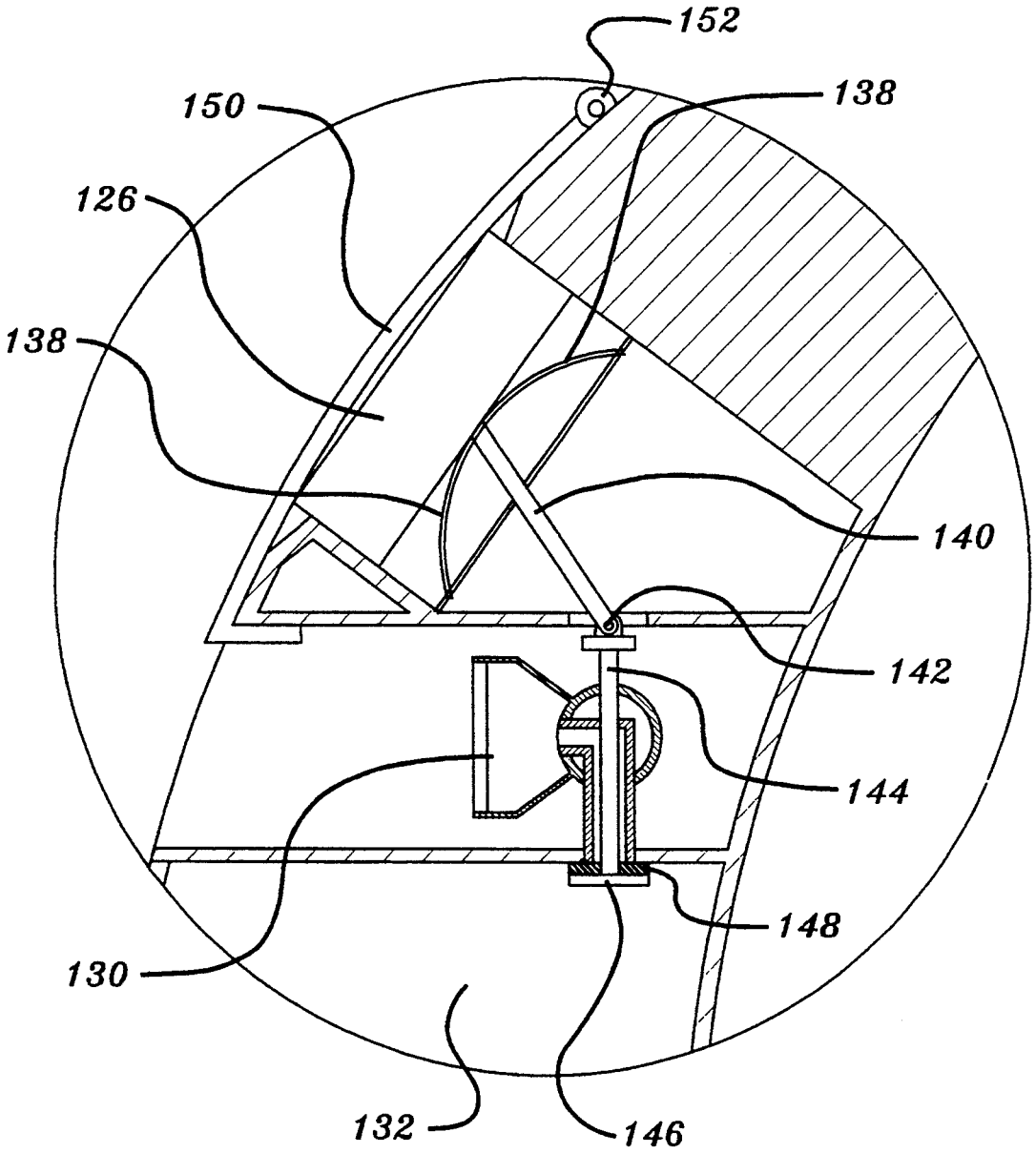
FIG. 7 is an expanded cross-sectional top view of the second preferred embodiment of the present invention taken inside circle 7 of FIG. 6.

A second embodiment self-protection bracelet 120 is shown in FIGS. 5–7. The second embodiment self-protection bracelet is very similar to the first embodiment with the addition of a signal horn which will blow at the same time that the chemical repellant is being sprayed to scare off an attacker and to alert other people that the wearer is in some type of trouble. The second embodiment bracelet 120 has an activation button 126 on its front face (rather than on top like the first embodiment). The button 126 is covered by a cover 150 and attached to the bracelet 120 by means of hinge 152.

The button 126 is connected to a pair of push rods 140 (for the repellant gas) and 240 (for the horn). Now referring particularly to FIG. 7, which shows the working parts of the repellant spray activation system in detail (the working parts of the horn activation system uses similar parts for its activation), a spring 138 urges the button 126 towards the front of the bracelet 120 and away from the push rods 140 and 240 (rod 240 hidden in this view). The push rods 140 are connected at their other ends, by means of a pair pivot joint 142 (only the pivot joint for the repellant can be seen in this view), to a pair of actuators bars 144 which can (under pressure on the button 126) open normally closed valve close pieces 146 allowing repellant gas to leave gas chamber 132 and spray out of gas spray outlet nozzle 130 and similarly allowing pressurized air to exit air chamber 232 to move through horn 230 causing the horn 230 to loudly blow. A pair of gasket seals 148 should be utilized to maintain a tight seal so that there is no leakage while the repellant and the air are being stored.

After the repellant/horn system 120 has been used, the repellant and the air can be refilled through refill valve 134 for gas chamber 132 and refill valve for air chamber 232 respectively.

The second embodiment system works similarly to the first embodiment by removing the button cover 150 away from the button 126 and pushing the button 126 to spray repellant and additionally blow the loud signal horn 230.

While it is preferred that a horn be used as the audible warning noise, any effective audible warning noise could be used and should be considered within the scope of the present invention.

It is apparent from the above that the present invention accomplishes all of the objectives set forth by providing a new and improved self-defense bracelet which contains a chamber for storing a chemical repellant such as Mace or tear gas or pepper gas or the like, and which may be inconspicuously worn by individuals and can be used to protect themselves in case they are attacked by pressing an activation button for spraying the attacker with the repellant.

The self-defense bracelet of the present invention provides personal protection to any person who has it strapped to their wrist. Rather than reaching into a pocket or bag to obtain a canister which is filled with Mace or other repellent, this innocuous looking device can be activated instantly by pressing a button to discharge a stream, directing it at an attacker (who is undoubtedly alert to avoid being sprayed by a typical prior art canister type repellent) with no warning of what is to take place. Anyone who is threatened or attacked needs every advantage in protecting themselves, and this invention will catch the molester completely off guard, so they can scream for help or escape.

The self-defense bracelet of the present invention has a canister that is shaped to fit around a wrist, and can be concealed under a fabric like terry cloth. It is attached around the wrist with a hook and loop fastener. Another hook and loop fastener flap conceals the discharge button and the tiny spray nozzle.

Under suspicious circumstances, the flap is opened, ready for a simple press of the button to foil the molester or would be attacker. The mace bracelet allows the wearer to appear to be completely oblivious to the potential for attack, while in reality the wearer can react almost instantly, making movements which will not alert the culprit.

The self-defense bracelet is preferably made of a light weight material like terry cloth material with velcro adjustable straps incorporated. Inside the bracelet is a canister shaped to the contour of the wrist and containing a self-defense chemical (mace-tear gas, etc.) with a velcro cover providing easy access to a push button dispenser.

The self-defense bracelet could be worn inconspicuously by virtually anyone.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as encompass all such modifications and equivalents.

What is claimed as being new and desired to be protected by Letters Patent of the United States is as follows:

1. A self-defense device for spraying an attacker with a chemical repellant comprising:

a bracelet having a storage compartment for holding the chemical repellant, said bracelet having first and second opposed ends and first and second opposed arcuate sidewalls extending between said first and second ends for defining said storage compartment, said bracelet further having an annular upwardly facing surface extending between said first and second ends in a longitudinal direction and extending between said first and second arcuate sidewalls in a transverse direction, nozzle means intercepting said annular surface for directing said chemical repellant from said storage compartment toward said attacker, activatable valve means inside said compartment for selectively causing said chemical repellant to flow through said nozzle means, manual activation means for selectively activating said valve means, said manual activation means being located in said first arcuate sidewall between said first and second opposed ends, and a removable flexible flap for concealing said nozzle, said flexible flap being coextensive with a portion of said surface, said flap being attached to said surface at one end and having a fastener element at another opposed end for affixing said flap to said surface and permitting removal thereof to expose said nozzle.

2. The invention of claim 1 further comprising a means for creating an audible warning signal.

3. The invention of claim 2 wherein said means for creating an audible warning signal is comprised of a second storage compartment for storing air under pressure and a signal horn, wherein upon the activating of said means for activating, the air will be forced out of said second storage compartment causing said horn to blow.

* * * * *